US008708180B2

(12) United States Patent
Nielsen

(10) Patent No.: US 8,708,180 B2
(45) Date of Patent: Apr. 29, 2014

(54) CONTAINER COMPRISING AN INNER LINING, A METHOD OF APPLYING SUCH A LINING TO A CONTAINER AND USE OF A PEELABLE COATING AS AN INNER LINING IN A CONTAINER

(75) Inventor: Benny E. Nielsen, Kalundborg (DK)

(73) Assignee: Superfos A/S, Taastrup (DK)

( * ) Notice: Subject to any disclaimer, the term of this patent is extended or adjusted under 35 U.S.C. 154(b) by 161 days.

(21) Appl. No.: 12/736,008

(22) PCT Filed: Jul. 11, 2008

(86) PCT No.: PCT/EP2008/059114
§ 371 (c)(1),
(2), (4) Date: Oct. 19, 2010

(87) PCT Pub. No.: WO2009/109234
PCT Pub. Date: Sep. 11, 2009

(65) Prior Publication Data

US 2011/0036845 A1 Feb. 17, 2011

(30) Foreign Application Priority Data

Mar. 3, 2008 (EP) ..... 08152201

(51) Int. Cl.
*B65D 1/40* (2006.01)
*B65D 17/34* (2006.01)
*B65D 30/08* (2006.01)
*B65B 61/18* (2006.01)

(52) U.S. Cl.
USPC ..... 220/62.22; 220/269; 383/111; 53/412

(58) Field of Classification Search
USPC ..... 220/62.22, 574.2, 578, 23.87, 495.01, 220/594.02, 495.06, 495.11, 695, 908.1, 220/269, 270, 257.2, 258.2, 634, 635; 383/111, 116; 206/524.3; 229/117.27; 215/12.2, 341; 427/230–237, 534; 53/412
See application file for complete search history.

(56) References Cited

U.S. PATENT DOCUMENTS 3,326,364 A * 6/1967 Waldrop et al. ..... 206/466
3,568,872 A * 3/1971 Logomasini ..... 220/1.5

(Continued)

FOREIGN PATENT DOCUMENTS

DE 4126964 2/1993
DE 4302613 8/1993

(Continued)

OTHER PUBLICATIONS

English Abstract of EP0659652, Jun. 1995.

(Continued)

*Primary Examiner* — Bryon Gehman
*Assistant Examiner* — Shawn M Braden
(74) *Attorney, Agent, or Firm* — Dykema Gossett PLLC

(57) ABSTRACT

The invention relates to a container (1) for holding fluid or particle compositions which container (1) comprises an inner lining (6) applied to an inner side (2) of the container (1), where the container (1) is provided with an inner lining (6) of a peel-able coating. The peel-able coating can be applied as water based, as Acetone based emulsion or as UV curable lacquer. The invention relates further to a method of manufacturing such a container (1), where the lining (6) is applied to the container (1) by following process steps: Applying a peel-able coating to the inner side of the container (1); Curing and/or drying the peel-able coating by heating, blowing or radiating by UV-light. Further the invention relates to the use of a peel-able coating as an inner lining (6) in a container (1) for fluid materials, such as paint or other materials able to leave residues on or in the container.

17 Claims, 2 Drawing Sheets

(56) References Cited

U.S. PATENT DOCUMENTS

| | | | | | |
|---|---|---|---|---|---|
| 3,610,455 | A | * | 10/1971 | Greenhalgh et al. | 215/12.1 |
| 4,747,701 | A | * | 5/1988 | Perkins | 383/33 |
| 4,884,990 | A | * | 12/1989 | Lovik | 446/220 |
| 5,492,242 | A | * | 2/1996 | Gall | 220/495.02 |
| 5,816,501 | A | * | 10/1998 | LoPresti et al. | 239/302 |
| 6,199,713 | B1 | * | 3/2001 | de Vries | 220/495.02 |
| 6,358,660 | B1 | * | 3/2002 | Agler et al. | 430/125.32 |
| 6,679,398 | B1 | * | 1/2004 | O'Brien | 220/495.02 |
| 7,007,816 | B2 | * | 3/2006 | Verderber | 215/254 |
| 7,731,048 | B2 | * | 6/2010 | Alvares et al. | 220/270 |
| 7,877,968 | B2 | * | 2/2011 | Kim et al. | 53/473 |

FOREIGN PATENT DOCUMENTS

| | | |
|---|---|---|
| EP | 0659652 | 6/1995 |
| EP | 1780047 | 5/2007 |
| FR | 2848189 | 6/2004 |
| GB | 1189450 | 4/1970 |

OTHER PUBLICATIONS

English Abstract of DE4302613, Oct. 1992.
English Abstract of EP1780047, Oct. 2005.
English Abstract of FR2848189, Nov. 2004.
English Abstract of DE4126964, Feb. 1993.

* cited by examiner

CONTAINER COMPRISING AN INNER LINING, A METHOD OF APPLYING SUCH A LINING TO A CONTAINER AND USE OF A PEELABLE COATING AS AN INNER LINING IN A CONTAINER

BACKGROUND OF THE INVENTION

1. Field of the Invention

The invention relates to a container for holding fluid or particle compositions and which includes an inner lining of a peelable coating applied to an inner side of the container where the peelable coating also is applied around an upper edge of the container and to the outside of a round going skirt extending downwards from an upper end of the outside of the container, and to a method of manufacturing such a container.

2. The Prior Art

In the past containers, i.e., which contain paint, have been thrown away after use.

As more and more of the materials kept or stored in such containers are categorised as being possibly damaging to the environment, the containers must not be thrown away in normal waste management.

It is therefore desirable to make it possible to separate remaining content from the container itself.

Only the residue needs to be disposed of as dangerous goods. The container can be recycled, i.e., as plastic scrap.

Such a solution is known from U.S. Pat. No. 6,679,398 B where a paint container liner system is described. The paint container liner system includes disposable liners and an open container for receiving at least one of the disposable liners. The liners are sized and configured to fit into the inside of the container and around the rim of the container. The liners are maintained in position in the container by a suction generated during installation, by a non curing adhesive interposed between the liner and the container, by the liners being stretched around the rim of the container or configured with a rounded bottom to retain the liner in place during use.

From U.S. Pat. No. 5,492,242 A is known that paint buckets and other sales packaging for paints, solvents and the like must be cleaned from contamination by residual amounts of the previous content before a reuse. Such a container is provided with protective layers which are applied to its container walls in several layers, which protective layers are separated by separating layers and which protective layers, starting from a detaching point, can be pulled off together with adhering contaminations so that the container can be reused again without any cleaning expenditures.

A problem with these known containers with liners is that when paint is sold, it is most often stored at the store in a basis colour and intended to be mixed into a colour selected by a customer.

When a colour is selected and a necessary amount of colour pigment is applied, the container is exposed to an excessive shaking in a shaking machine. When exposing a container relating to prior art to such an excessive shaking, it is very likely that the protective layer(s) will detach from the inner side of the container.

When the customer at a later time is ready to use the paint, it is necessary to perform a mixing or stirring to make sure that the colour is fully blended and thereby has obtained the correct colour.

If the protective layer has been detached from the inner side of the container, it is very difficult to perform a sufficient mixing of the paint.

SUMMARY OF THE INVENTION

A solution to this problem is to provide a protective layer, easy to apply to the container and easy to remove from the container after use, which layer will not detach during excessive shaking of the container.

This is achieved according to the invention in that the container is provided with an inner lining of a peelable coating and where a removable tab in a transition area between a body or middle portion of the tab and the round going skirt is provided with a weakening line or a number of connection points to be broken when tearing off the removable tab attached to the peelable layer.

An advantage achieved by applying such a protective peelable coating or layer to a container is that when the container is emptied, residues normally remain on the inner side of such a container. By applying the protective peelable layer to the inner side of the container before filling, it is possible to remove the protective layer in one piece covering the inner side of the container, the piece now forming a kind of bag being able to enclose the residues. When the protective layer is removed from the container, the residues together with the peelable protective layer can be disposed of as dangerous goods if necessary, and the container can be used again or recycled, i.e., as plastic scrap.

It is important that the peelable layer does not disintegrate when peeled off, the container thereby being able to contain the residues left on the inner side of the layer.

The peelable layer can be removed by hand or by a suitable tool, the tool being operated by hand or automatically.

The tool can be a removable tab placed on the upper edge of the container.

In further embodiments the peelable coating is applied as water-based or Acetone-based emulsion.

In another embodiment the coating is cured by UV light.

In yet further embodiments the peelable coating is applied as water-based (e.g., acrylic), acetone (e.g., PVC)-based emulsion, or as a UV curable lacquer.

In another embodiment according to the invention the thickness of the lining is in the range from 50-400 μm, alternatively 50-300 μm.

Hereby it is achieved that it is possible to stack the containers after applying the inner lining without significantly increasing the stacking height.

To ensure a sufficient adherence to the container, whether the container is just ready from the mould or if it is a previously produced "standard" container originally intended for a completely other purpose, or even if the container is a used container, the container is provided in a further embodiment with a roughened surface on the inner side of the container.

In yet an embodiment the roughened surface is applied only on the side of the container and not to the bottom.

A solution to the above problem is also achieved by a method where the lining is applied to the container by following process steps:

- Applying a peel-able coating to the inner side of the container;
- Curing and/or drying the peel-able coating by heating, blowing or radiating by UV-light.

In another embodiment the inner side of the container is roughened by blasting from particles.

In other embodiments of the method the peelable coating is applied by spraying, by a roller or by spinning or rotating the container.

In further an embodiment the inner side of the container is roughened by blasting of sand or glass particles or by corona or flame treatment.

In another embodiment the lining is applied directly after the container is moulded.

This gives the possibility to apply the lining when the position of the container is well determined and unnecessary movement is reduced.

In yet an embodiment the lining is applied to a container being a previously produced container.

In further an embodiment the containers are stacked shortly after applying the inner lining.

This reduces intermediate storing space and unnecessary movement of the containers.

A solution to the above problem is also achieved by a method where the container is provided with a removable tab in a transition area between a body or middle portion of the tab and the round going skirt is provided with a weakening line or a number of connection points to be broken when tearing off the removable tab attached to the peelable layer.

In a further embodiment the peelable coating or layer also is applied around the upper edge of the container and to the outside of a round going skirt extending downwards from the upper end of the outside of the container.

BRIEF DESCRIPTION OF THE DRAWINGS

Embodiments will now be discussed in further detail with reference to the accompanying drawings in which.

DETAILED DESCRIPTION OF THE PREFERRED EMBODIMENTS

Figure 1:
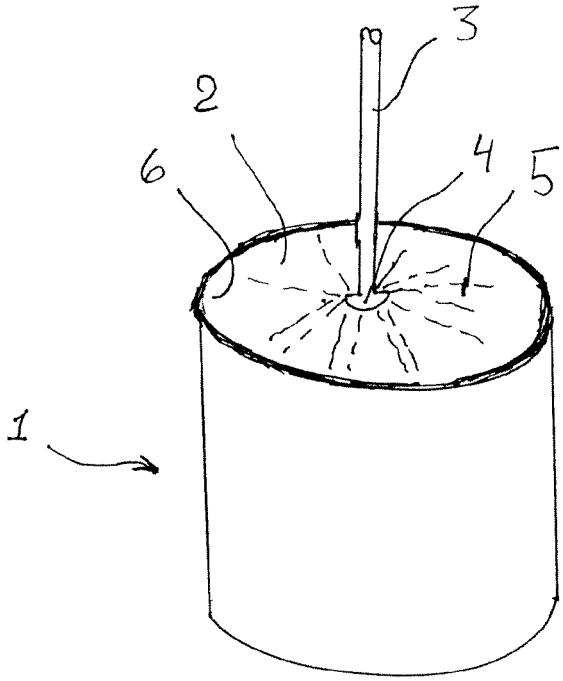
FIG. 1 schematically shows a container being provided with a protective layer, and FIG. 2 schematically shows a container with a left side cut away and a right side provided with a lid.
Figure 2:
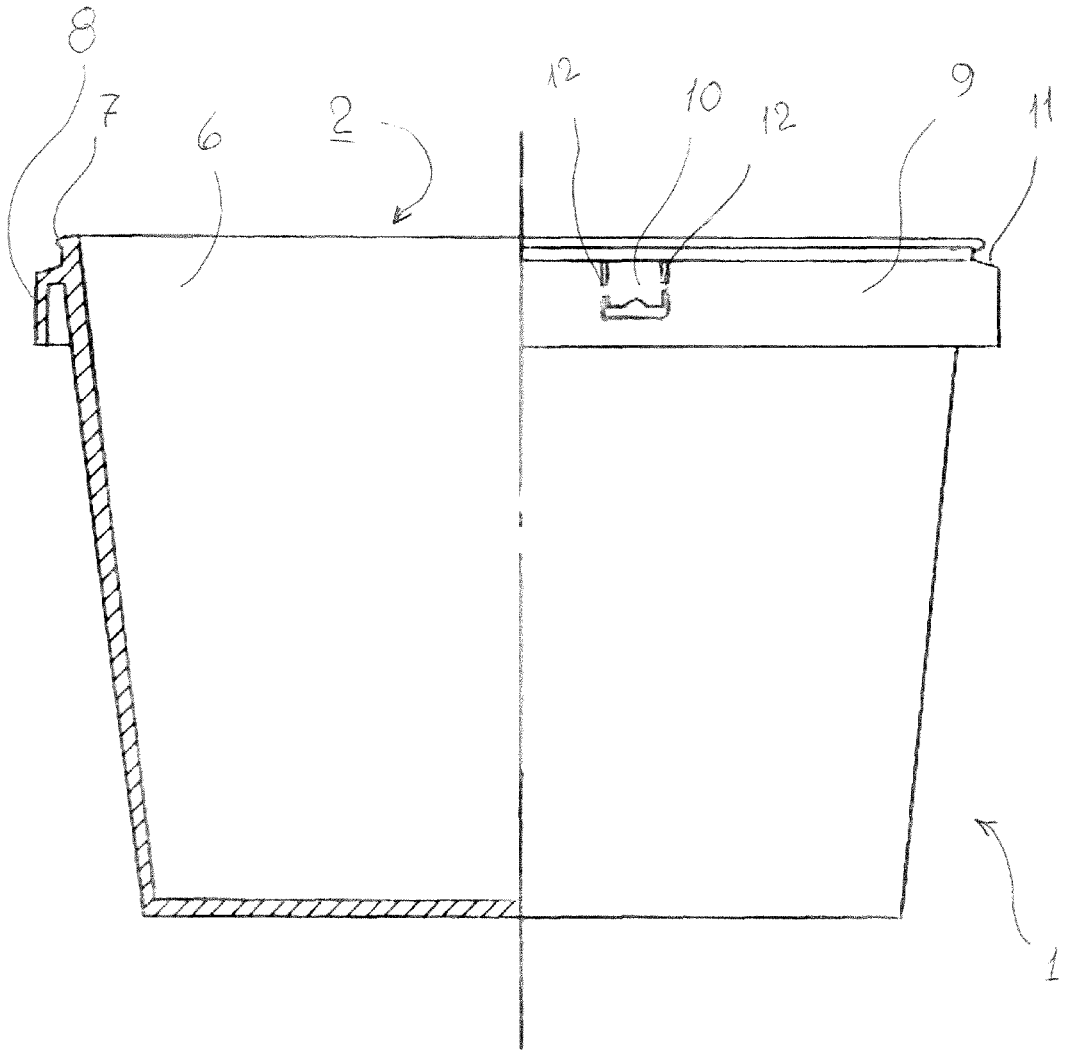

The drawing in principle shows how a container 1 is provided with a protective layer 6 according to an embodiment of the invention. The invention is not limited to a single embodiment, but comprises further embodiments derived from the specification.

These objectives can be achieved by applying a peelable film or layer 6 on the inside surface 2 of a container 1. The film or layer 6 is applied to the container 1 before filling with paint or other fluids. When the container 1 is emptied of paint or other fluids, it is possible to remove the residue by peeling off the film or layer 6. When peeled, the film or layer 6 turns into a bag containing the paint or other fluid residue and thus leaving the container 1 clean from paint or other fluid.

A peelable coating shows remarkably good properties to be used in combination with such a container 1, which is mostly produced in a kind of plastics.

In an embodiment of the invention the peelable coating is applied as water-based or acetone-based emulsion.

In yet further embodiments the peelable coating is applied as water-based (e.g., acrylic) or acetone (e.g., PVC)-based emulsion or as a UV-curable lacquer.

These are commercially available products, but intended for completely other applications.

Once applied, the peelable coating dries into a solid film or layer 6 and after curing the surface is resistant to paint.

To speed up the drying process, curing can be provided by drying and/or heating by blowing a gas, such as air, at a temperature selected according to the desired curing time into the container.

Curing can also be provided by radiation from one or more UV light sources.

To ensure in an embodiment a further adherence to the container, whether the container 1 is just ready from the mould, or if it is a previously produced "standard" container originally intended for a completely other purpose, or even if the container 1 is a used container, the container 1 is provided in a further embodiment with a roughened surface on the inner side 2 of the container 1. The roughened surface on the inner side 2 of the container 1 is provided by particle blasting or by corona or flame treatment.

The peelable coating or layer will then have a sufficient weak adherence to the plastic container to be peeled off after use but an adherence strong enough to stay in place during filling, transport and tinting/shaking.

When the peelable coating is applied, which application can be performed by spraying, rolling, by pouring a sufficient amount of peelable coating into the container and following spin or rotate the container in such a way, that the peelable coating will be applied to all over the inner side of the container. How long the spinning or rotating period should be, depends on the temperature and on the desired thickness of the protective layer.

FIG. 1 shows a simple way to apply the peel-able coating by a nozzle 4 at a supply tube 3, which nozzle 4 produces a spray 5 and thereby applies a protective film or layer 6 in form of a lining on the inner side 2 of the container 1.

When the peelable coating is applied, a curing of the applied layer can be performed.

Again the curing period depends on other parameters as well as on the curing method.

The protective and peelable layer protects the container from paint or like fluids or particle materials to residue on the inner side of the container.

Applying such a layer to the container makes it possible to produce the container from a less expensive material. The protective layer also can provide barrier means preventing compositions aggressive to the material used for the container to come into contact with the container wall. An example can be protection of the container to solvent based liquids.

A further advantage to the invention is that the layer applied to the container is a relatively thin layer. Normally the thickness of the layer will be in the range from 50-400 μm, alternatively 50-300 μm.

Having such a thin layer makes it possible to stack the containers.

Hereby is achieved an adherence to the plastic surface weak enough to allow easy removal of the film or layer and a film or layer itself strong enough to stay in one piece when removed from the container, acting as a bag containing the paint residue.

In another embodiment the lining is applied directly after the container is moulded.

This makes it possible to apply the lining when the position of the container is well determined and unnecessary movement is reduced.

In yet an embodiment the lining is applied to container being a previously produced container, giving the possibility to make use of other containers or even previously used containers.

In further an embodiment the containers are stacked shortly after applying the inner lining which also reduces unnecessary movement or handling of the containers.

In a further embodiment the peelable coating 6, 9 also is applied around the upper edge 7 of the container 1 and to the outside of a round going skirt 8 extending downwards from the upper end of the outside of the container 1.

The upper edge of the container 1 is on the outside provided with a bead or ridge 7 intended to snap into a corresponding groove in a lid, which lid (not shown) when applied will abut an upper shoulder 11 of the round going skirt 8.

The peelable coating 6, 9 applied to the area around the bead or ridge 7 will provide a further sealing between the container 1 and the lid compared to a situation where no peelable coating is applied.

When the peelable coating 6, 9 is applied to the inner side of the container, and as well on the outside of the upper edge 7 it is possible to avoid contamination by residual amounts of the previous content before a reuse of the container 1.

To make it easier to remove (peel off) the peelable layer a removable tab 10 is provided in the round going skirt 8. The removable tab 10 is in a transition area between the body or middle portion of the tab 10 and the round going skirt 8 provided with a weakening line or a number of connection points 12 to be broken when tearing off the removable tab 10.

When tearing off the removable tab 10, the peelable layer 6, 9 attached to the tab 10 will detach from the round going skirt 8 and from the inner side 2 of the container 1. Hereby it is possible to remove the peelable layer 6, 9 in an easy and effective manner without tearing the peelable layer 6, 9 apart and thereby be sure that the residues from paint or the like is held inside the kind of bag provided by the peeled off peelable layer.

The peelable layer 6, 9 can be applied around the upper edge of the container 1 by spraying or by a roller. The container can be fixed in a template which abuts the underside of the round going skirt 8, preventing the peel-able layer from being applied to the rest of the outer side of the container 1.

The container 1 can be held in a not rotating position or it can be rotated during applying the peelable coating 6, 9.

In a further embodiment of the container 1, the outer side of the round going skirt 8 can be provided with a roughened surface.

In the above the container is mainly described as a container for containing paint, but it is obvious that it is possible to use the invention in relation to other materials able to leave residues on or in the container.

The invention also applies to the use of a peel-able coating as an inner lining in a container for fluid or particle materials, such as paint or other materials able to leave residues on or in the container.

The invention is not limited to the use of the mentioned peel-able coating since any suitable peel-able coatings can be used as long as they fulfil the properties described herein.

The invention claimed is:

1. A method of manufacturing a container with peelable liner for holding fluid or particle compositions, which comprises:

providing an injection molded container having a rounded side wall that defines an inner surface, an upper edge, an outer surface, and a downwardly-extending skirt which is one piece with the outer surface and extending therearound near said upper edge, said downwardly-extending skirt comprising a tab which is one piece with the skirt and having a weakening line or a plurality of connection points between the tab and the skirt to enable said tab to be torn away from said skirt, and applying a peelable coating over said inner surface of said rounded side wall as a liner, over said upper edge and over said downwardly-extending skirt and tab, such that tearing said tab away from said skirt will cause said peelable coating to be removed from said skirt and side wall.

2. The method according to claim 1, wherein at least one of the inner surface, the upper edge and the outer surface of the container is roughened by blasting with particles.

3. The method according to claim 1, wherein the peelable coating is applied by spraying.

4. The method according to claim 1, wherein the peelable coating is applied by a roller.

5. The method according to claim 1, wherein the peelable coating is applied by spinning or rotating the container.

6. The method according to claim 1, wherein at least one of the inner surface, the upper edge and the outer surface of the container is roughened by corona or flame treatment.

7. The method according to claim 1, wherein the lining in the form of the peelable coating is applied directly after the container (1) is moulded.

8. The method according to claim 1, wherein the lining is applied to a previously produced container.

9. The method according to claim 1, comprising manufacturing a plurality of said containers, and wherein the containers are stacked shortly after applying the inner lining or peelable coating.

10. A container with peelable liner for holding fluid or particle compositions which comprises:

(a) an injection molded container having (i) a rounded side wall that defines an inner surface, an upper edge and an outer surface, and (ii) a downwardly-extending skirt which is one piece with the outer surface and extending therearound near said upper edge, said downwardly-extending skirt comprising a tab which is one piece with the skirt and having a weakening line or a plurality of connection points between the tab and the skirt to enable said tab to be torn away from said skirt, and (b) a peelable coating over said inner surface of said rounded side wall as a liner, over said upper edge and over said downwardly-extending skirt and tab, such that tearing said tab away from said skirt will cause said peelable coating to be removed from said skirt and side wall.

11. The container according to claim 10, wherein the peelable coating is applied as a water-based emulsion.

12. The container according to claim 10, wherein the peelable coating is applied as an Acetone-based emulsion.

13. The container with peelable liner according to claim 10, wherein the peelable coating is applied as a UV-curable lacquer.

14. The container with peelable liner according to claim 10, wherein the peelable coating has a thickness of 50-400 μm.

15. The container according to claim 10, wherein the inner surface of the container comprises a roughened surface.

16. The container according to claim 10, wherein the outer surface of the rounded side wall comprises a roughened surface.

17. The container with peelable liner according to claim 10, wherein said tab is generally U-shaped and extends downwardly relative to the upper edge of the container.

* * * * *

UNITED STATES PATENT AND TRADEMARK OFFICE

CERTIFICATE OF CORRECTION

PATENT NO. : 8,708,180 B2
APPLICATION NO. : 12/736008
DATED : April 29, 2014
INVENTOR(S) : Benny E. Nielsen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 260 days.

Signed and Sealed this
Twenty-ninth Day of September, 2015

Michelle K. Lee

Michelle K. Lee
*Director of the United States Patent and Trademark Office*